US008718880B2

(12) United States Patent
Cadman et al.

(10) Patent No.: US 8,718,880 B2
(45) Date of Patent: May 6, 2014

(54) HYDRAULIC SYSTEM CALIBRATION METHOD AND APPARATUS

(75) Inventors: Kristen D. Cadman, Dubuque, IA (US); Elizabeth H. Steenbergen, Gilbert, AZ (US)

(73) Assignee: Deere & Company, Moline, IL (US)

( * ) Notice: Subject to any disclaimer, the term of this patent is extended or adjusted under 35 U.S.C. 154(b) by 738 days.

(21) Appl. No.: 12/918,198

(22) PCT Filed: Mar. 10, 2008

(86) PCT No.: PCT/US2008/056395

§ 371 (c)(1),
(2), (4) Date: Nov. 22, 2010

(87) PCT Pub. No.: WO2009/114003

PCT Pub. Date: Sep. 17, 2009

(65) Prior Publication Data

US 2011/0061448 A1 Mar. 17, 2011

(51) Int. Cl.
*G08B 29/20* (2006.01)

(52) U.S. Cl.
USPC ..... 701/50; 73/37

(58) Field of Classification Search
None
See application file for complete search history.

(56) References Cited

U.S. PATENT DOCUMENTS

| | | | | |
|---|---|---|---|---|
| 4,931,967 | A | 6/1990 | Boe et al. | |
| 5,472,056 | A | 12/1995 | Orbach | |
| 5,475,561 | A | 12/1995 | Goeckner et al. | |
| 5,957,213 | A | 9/1999 | Lorass et al. | |
| 6,058,343 | A * | 5/2000 | Orbach et al. | 701/50 |
| 6,341,552 | B1 * | 1/2002 | Potter et al. | 91/433 |
| 6,571,190 | B2 | 5/2003 | Hou et al. | |
| 6,615,114 | B1 * | 9/2003 | Skiba et al. | 700/275 |
| 6,672,412 | B1 | 1/2004 | Charlson | |
| 8,061,180 | B2 * | 11/2011 | Green | 73/1.72 |
| 2002/0161541 | A1 * | 10/2002 | Hou et al. | 702/105 |
| 2007/0193263 | A1 * | 8/2007 | Otaka et al. | 60/445 |
| 2007/0234340 | A1 * | 10/2007 | Strosser et al. | 717/173 |
| 2008/0053191 | A1 * | 3/2008 | Yoo et al. | 73/1.72 |
| 2009/0223358 | A1 * | 9/2009 | Green | 91/361 |
| 2009/0277243 | A1 * | 11/2009 | Zhang et al. | 73/1.16 |
| 2010/0036534 | A1 * | 2/2010 | Ding | 700/282 |
| 2010/0252354 | A1 * | 10/2010 | Hamkins et al. | 180/367 |

OTHER PUBLICATIONS

Written Opinion for PCT/US2008/056395, dated Sep. 23, 2010. (6 pages).

* cited by examiner

*Primary Examiner* — Fadey Jabr
*Assistant Examiner* — Krishnan Ramesh
(74) *Attorney, Agent, or Firm* — Quarles & Brady LLP

(57) ABSTRACT

A ground engaging vehicle including a frame, an engine connected to the frame, a controller, and a hydraulic system powered by the engine. The hydraulic system includes a plurality of actuators, a plurality of valves, and at least one sensor. The plurality of valves include a first valve associated with a corresponding one of the plurality of actuators. Each of the plurality of valves is operatively connected to the controller. The at least one sensor is adapted to send a signal to the controller indicating a hydraulic connectivity through the first valve. The controller is adapted to open the first valve allowing hydraulic fluid to pressurize a first actuator until the first actuator is driven to an end of its stroke. The controller is further adapted to close the valve and send an increasing current to the valve. The at least one sensor detects a hydraulic connectivity through the valve and the controller is adapted to establish a threshold current value as the value of the increasing current when the at least one sensor detects the hydraulic connectivity through the valve.

13 Claims, 4 Drawing Sheets

HYDRAULIC SYSTEM CALIBRATION METHOD AND APPARATUS

FIELD OF THE INVENTION

The present invention relates to a hydraulic system calibration method, and, more particularly to hydraulic system calibration method associated with a ground-engaging vehicle.

BACKGROUND OF THE INVENTION

Construction equipment utilizes power sources such as diesel engines to provide power to move the construction equipment from location to location and power the hydraulic and electrical systems thereon. The hydraulic system typically includes a hydraulic pump that is driven by the engine supplying pressurized hydraulic fluid drawn from a reservoir. The pressurized hydraulic fluid is directed by an operator using levers, pedals and/or joysticks. The control systems may include positional controls that are moved by the operator with the change in position of the control being electrically detected by sensing devices. The position of the controls is conveyed to a controller circuit. The controller circuit interprets the signals and provides controlling signals in the form of electrical current to electro-hydraulic valves so that the pressurized hydraulic fluid can be directed to a hydraulic cylinder as directed by the operator.

The amount of electrical current required to actuate a valve is dependent upon the characteristics of the valve and the variation of manufacturing tolerances of both the electrical actuation portion and the mechanical characteristics of the valve itself. For example, variations in the valve mechanism can alter the amount of physical force needed to actuate the valve. Additionally, electrical variables, such as the number of turns of a coil can vary somewhat from coil to coil thereby providing a variation in the operation of the valve. A proportional valve, which may be operated by a servomechanism or similar type device, may also vary from unit to unit thereby creating some uncertainty as to the amount of current necessary to actuate the valve.

What is needed in the art is a simple self-contained calibration method to functionally remove variability inherent with the construction of an electro-hydraulic valve.

SUMMARY OF THE INVENTION

The present invention provides a calibration method and system for the calibration of electro-hydraulic valves on a piece of construction equipment utilizing the elements of the construction equipment and without the use of outside equipment.

The invention in one form is directed to a ground-engaging vehicle including a frame, an engine connected to the frame, a controller, and a hydraulic system powered by the engine. The hydraulic system includes a plurality of actuators, a plurality of valves, and at least one sensor. The plurality of valves include a first valve associated with a corresponding one of the plurality of actuators. Each of the plurality of valves is operatively connected to the controller. The at least one sensor is adapted to send a signal to the controller indicating a flow of hydraulic fluid through the first valve. The controller is adapted to open the first valve allowing hydraulic fluid to pressurize a first actuator until the first actuator is driven to an end of its stroke. The controller is further adapted to close the valve and send an increasing current to the valve. The at least one sensor detects a flow of hydraulic fluid through the valve and the controller is adapted to establish a threshold current value as the value of the increasing current when the at least one sensor detects the flow of the hydraulic fluid through the valve.

DETAILED DESCRIPTION OF THE INVENTION

Figure 1:
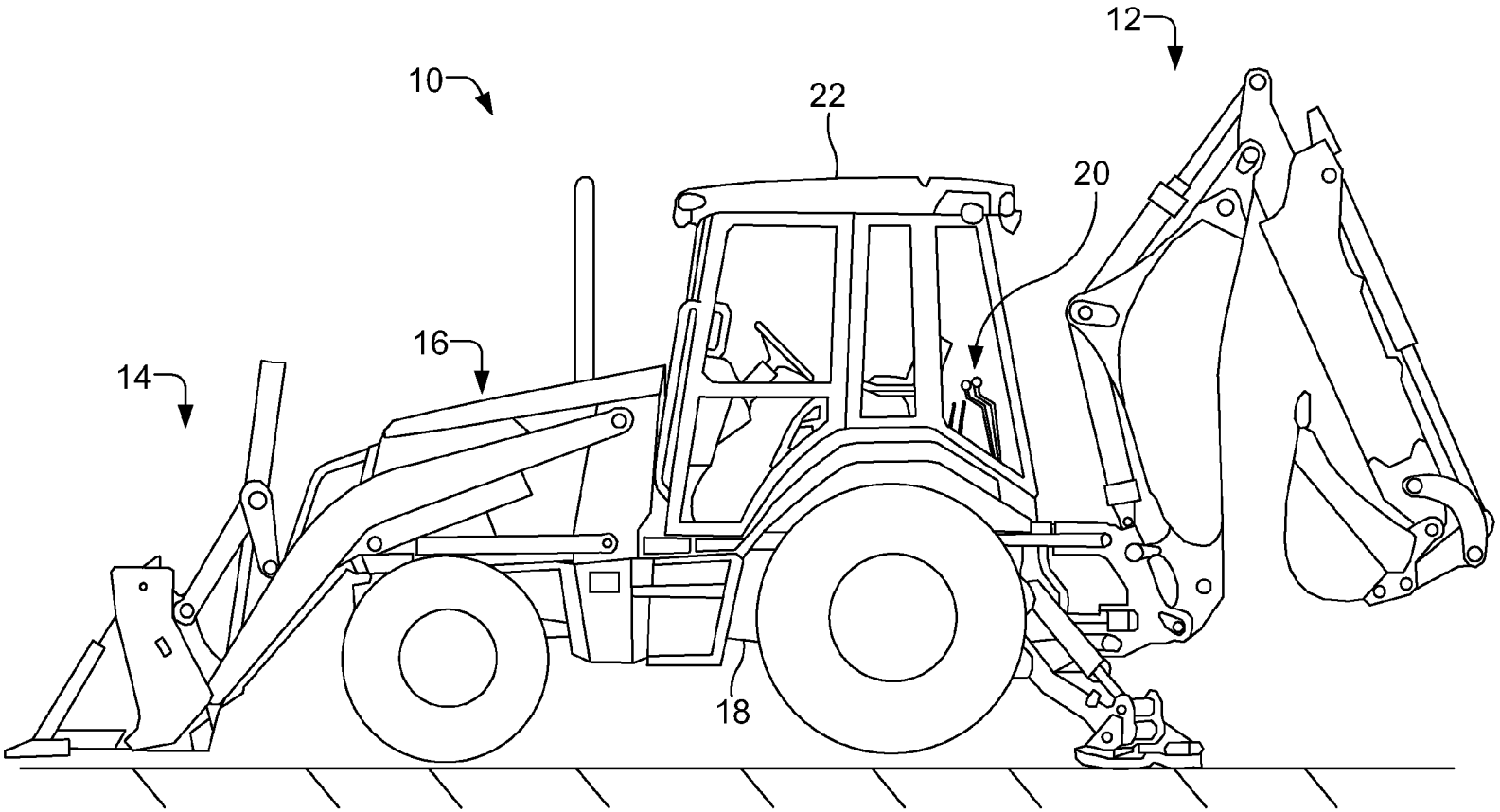
FIG. 1 is a side view of a ground engaging vehicle, in the form of a backhoe/loader that utilizes an embodiment of the calibration system of the present invention.

Referring now to the drawings, and more particularly to FIG. 1 there is shown a backhoe/loader system 10 including a backhoe section 12, a loader section 14, an engine 16, a frame 18, operator controls 20 and a cab 22. Backhoe/loader system 10, also known as a ground-engaging vehicle 10 has an engine 16 that operatively drives the hydraulic system that provides hydraulic power to actuators associated with both backhoe portion 12 and loader 14. Operator controls 20 located inside of cab 22 may include a variety of levers, foot pedals and/or joysticks for the operation of various hydraulic cylinders of system 10.

Figure 2:
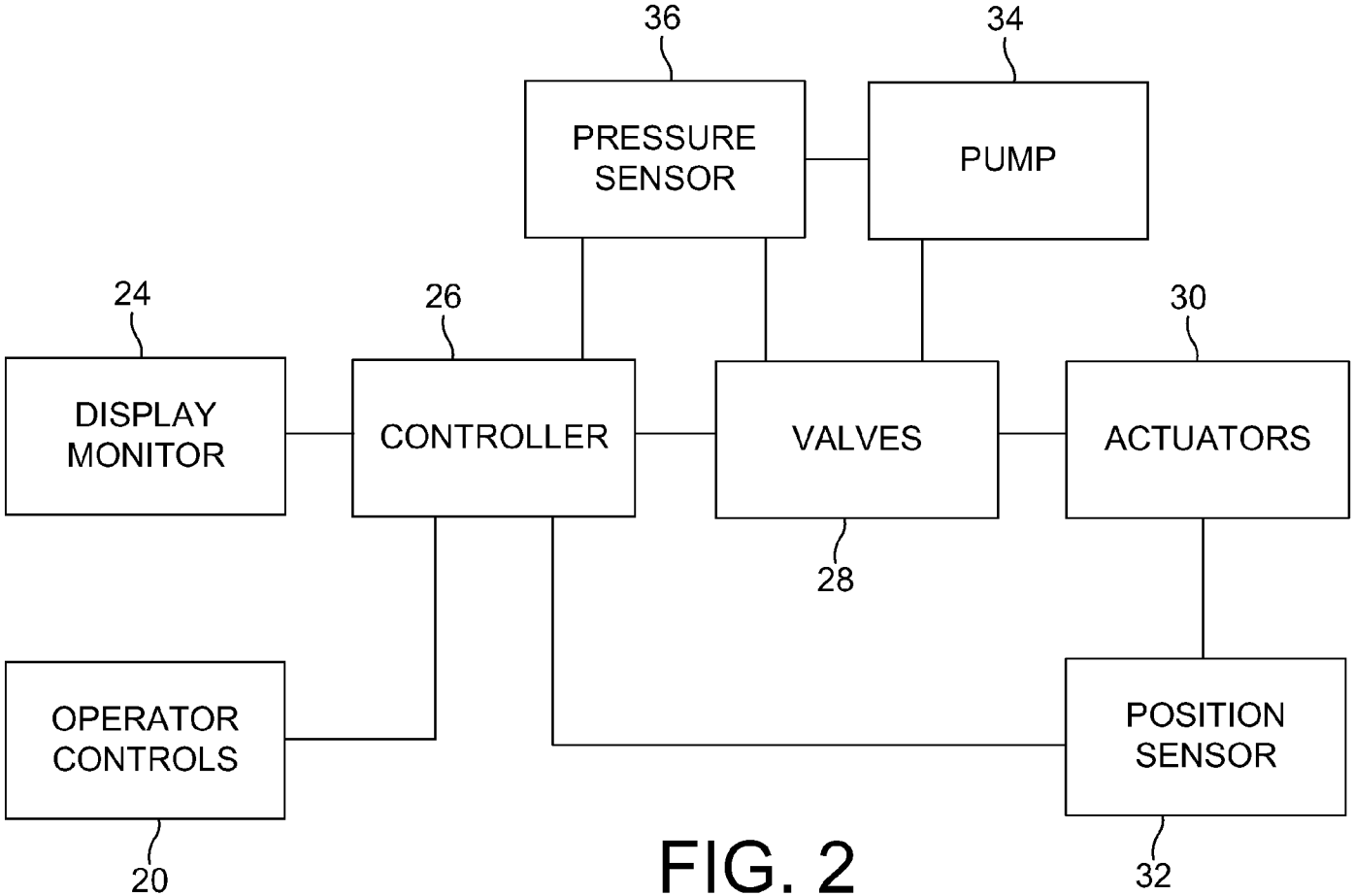
FIG. 2 is a schematical diagram illustrating the interconnection of portions of systems used by calibration system used in the backhoe/loader of FIG. 1.

Now, additionally referring to FIG. 2 there are shown elements associated with system 10 that are utilized by the method of the present invention including a display monitor 24, a controller 26, valves 28, actuators 30, position sensors 32, a pump 34 and pressure sensors 36. Display monitor 24 is located in cab 22 and provides the operator information about the operation of systems within backhoe/loader 10. For example, display monitor 24 may provide status information on the engine, electrical and hydraulic systems. Further, display monitor 24 can issue commands to the operator as well as allow the operator to select choices thereon. Display monitor 24 is under the operative control of controller 26 that sends information to display monitor 24 and receives information both from display monitor 24 and operator controls 20 from the operator.

Pump 34 provides hydraulically pressurized fluid to valves 28, which then direct pressurized fluid to actuators 30. The interconnecting lines although depicted as a single line in FIG. 2 is meant to convey the meaning that there are multiple independent paths between valves 28 to associated corresponding actuators 30 throughout system 10. Actuators 30 include the hydraulic cylinders associated with backhoe section 12 and loader section 14. Position sensors 32 likewise are each coupled to corresponding actuators 30 and provides positional information to controller 26.

Pressure sensors 36 provide pressure information to controller 26 of the hydraulic fluid pressure at locations associated with valves 28. Pressure sensed by pressure sensor 36 is dependent upon its position in the fluid flow through valves 28. For example, pressure sensor 36 can be located to read the pressure in the pressurized line between valve 28 and an actuator 30. In contrast, pressure sensor 36 may be located on the low-pressure side of valve 28. Valves 28 are electro-hydraulic valves 28 that include information that is accessible by controller 26. Information associated with each valve 28 includes a threshold electrical current necessary to start flow of fluid through a particular valve 28 as well as a maximum flow current where maximum flow through the valve is accomplished at that electrical current. The initial values of the threshold current and maximum flow current may be established by the manufacturer of the valve, or by a previous calibration, and is utilized by the present method. Since there can also be a variation in the measurement of current at the manufacturer and by controller 26 the calibration values established for each valve 28 are updated by the present invention.

The method of the present invention is initiated by the operator or upon a predetermined condition. Predetermined conditions may include the complete removal of electrical power from system 10 or after a disconnection of valve 28 is detected.

Figure 3:
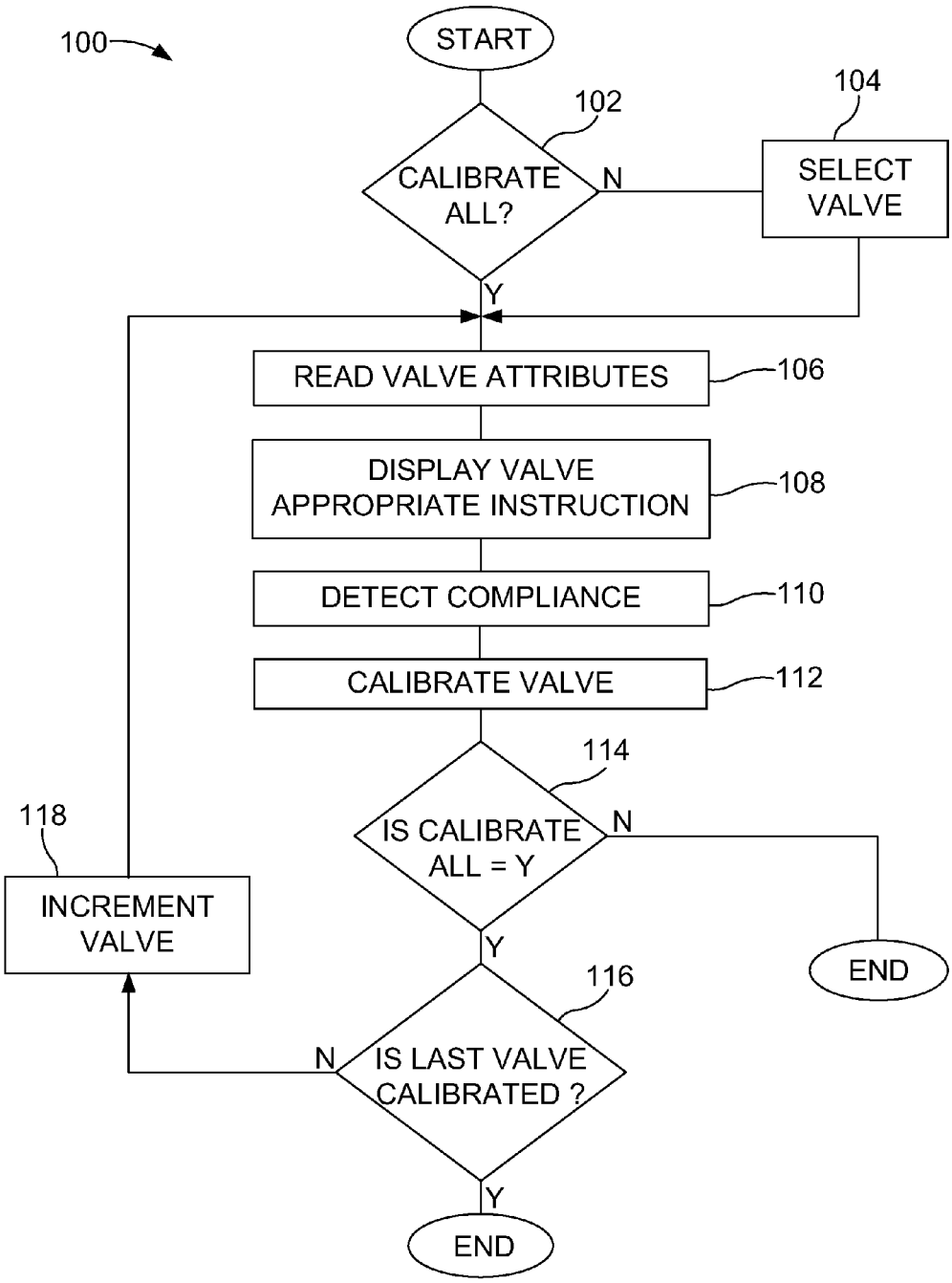
FIG. 3 is a flow chart illustrating elements of the calibration method used in FIGS. 1 and 2.

Now, additionally referring to FIG. 3 there is shown a method 100 that is carried out by the elements discussed above. One initiation of the present method is that an operator selects the calibration method by selecting the option from elements displayed on display monitor 24. Once method 100 is initiated, the operator is prompted to select whether all valves are to be calibrated at step 102. If only one valve is to be calibrated then the operator selects that valve at step 104. The attributes associated with a valve 28 is read at step 106 those attributes include the threshold current and maximum flow current of each valve that was previously stored. The threshold current and maximum flow current for the selected valve, utilized in the present method, is considered the initial values. The initial threshold value and the initial maximum flow current value are measured and stored in a memory associated with the valve by the manufacture or are the values saved during the last calibration of the valve. At step 108 instructions are displayed on monitor 24 that tell the operator to move a particular control to a particular position, such as raising the boom and to keep holding that control, such as a stick, while the calibration method detects the full stroke movement of the hydraulic cylinder associated with the boom. The full stroke of the boom may be detected by a position sensor 32 and pressure sensor 36 will show a full system pressure, which can be on the order of 3625 psi. The operator continues to hold the stick in the position while the method detects compliance of the operator to the instructions, at step 110. While the operator continues to hold the particular operator control 20 in the instructed position the valve is calibrated at step 112.

Figure 4:
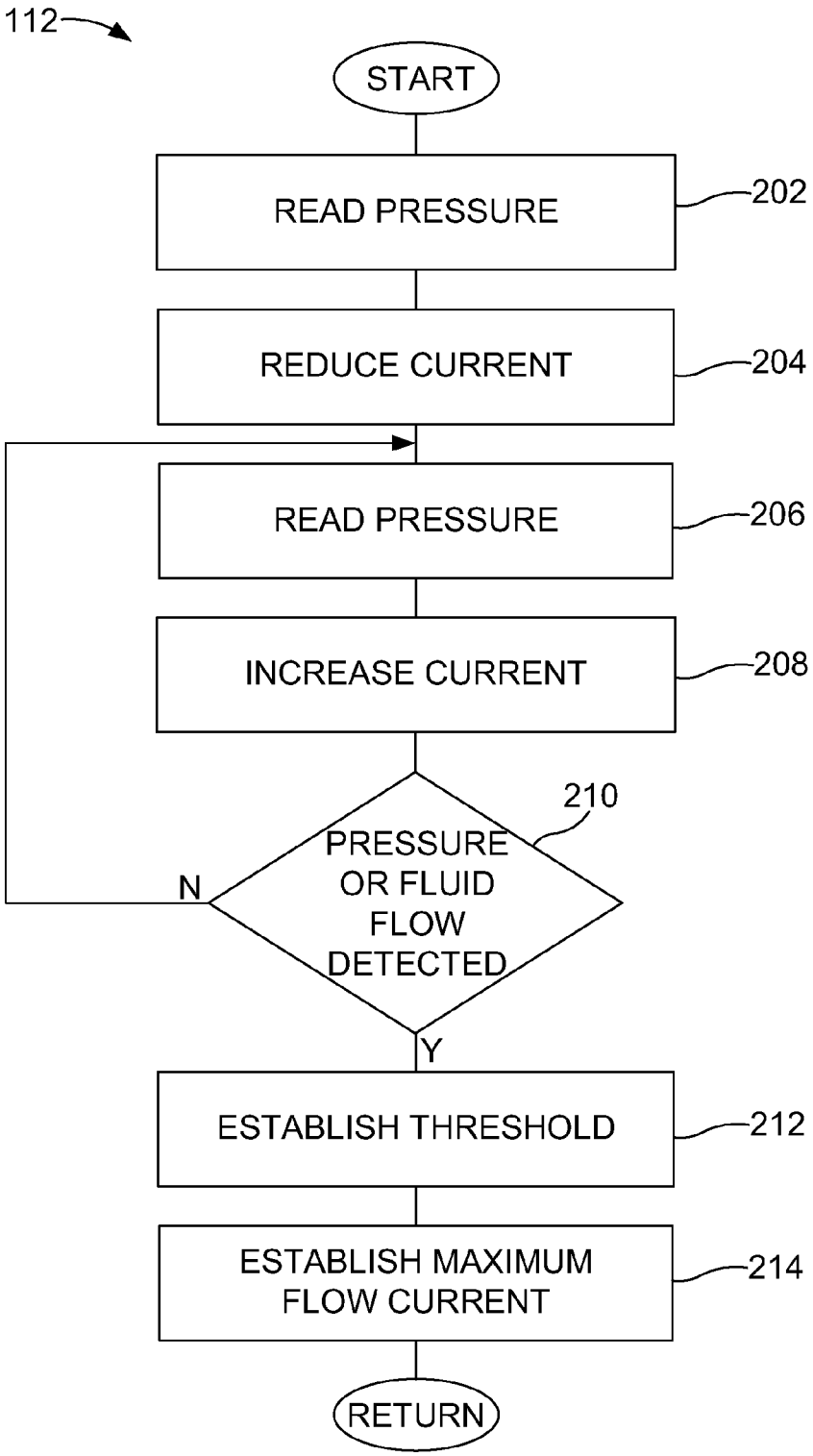
FIG. 4 is a flow chart illustrating a further method utilized in the method of FIG. 3.

Now, additionally referring to FIG. 4 there is illustrated method 112 for the pressure associated with the selected hydraulic cylinders read at step 202. The current supplied to the selected valve 28 is reduced to either a zero or a low value, such as 400 milliamps. The current is reduced at step 204 to ensure that valve 28 is closed. Steps 206, 208 and 210 are repeated until fluid flow is detected through the selected valve 28 by the detection of reduction in backpressure in the hydraulic cylinder as valve 28 is opened. This is accomplished by reading pressure at step 206 incrementally increasing the current supplied to valve 28 at step 208 and controller 26 deciding if fluid flow has been detected at step 210. If no fluid flow is detected then steps 206, 208 and 210 repeat. Once fluid flow is detected at step 210 then the threshold current is established at step 212. This is the minimum current for operating valve 28. A new maximum flow current is established at step 214. The new maximum flow current is established by taking the initial maximum flow current and adding to it the difference between the threshold established by method 112 and the previous threshold value read at step 106. This new maximum flow current is then saved either in controller 26 or in the memory associated with valve 28. Additionally the threshold current is saved and replaces the initial threshold current that is read at step 106. Method 112 then moves to step 114, which simply uses the decision made at step 102 to determine whether one valve is being calibrated or all of the valves are being calibrated. If all the valves are being calibrated method 100 moves to step 116 to determine if the last valve has been calibrated. If the last valve has not been calibrated then method 100 proceeds to step 118 where the next valve is selected and the method returns to step 106 to thereby provide further instructions to the operator to operate another control.

The use of pressure sensor 36 to detect the flow of a backpressure from its selected actuator 30 is for purpose of illustration and may be carried out by a sensor other than a pressure sensor, such as a flow detector. The communications to and from controller 26 can be considered signals and in the case of signal to a valve 28 may be in the form of a current value that is proportionally selected to cause a desired flow of fluid through the valve. For example, with the establishment of the threshold current and the maximum flow current, the fluid flow through a valve 28 may be calculated as beginning at the threshold current flow and the maximum flow occurring when the maximum flow current is supplied to the selected valve 28.

The calibration procedure uses controller 28, which may also be known as an electro-hydraulic system controller on the controller area network (CAN) to identify the current threshold where flow begins through the valve and calculates the current where the maximum flow is achieved by utilizing the stored information associated with a valve 28. The increase in current at step 208 is under the control of controller 26 and is increased until the pressure rise in the load-sense system is detected with the integrated pressure sensor 36. The pressure rise is a characteristic trait indicating that the communication passages of valve 28 are open to commence flow to an actuator. Once the threshold current and maximum flow current points are identified by the present invention, a control algorithm is used to estimate the flow relationship that can be used for the control of the hydraulic actuators.

In one embodiment of the present invention, at step 202, system stall pressure of an actuator 30 is detected by pressure sensor 36 on the outlet of pump 34, the stall pressure may be 3625 psi, as actuator 30 is fully extended. As the current is reduced in step 204, system pressure drains off to a standby pressure of about 110 psi as measured by pressure sensor 36. As method 112 iterates through steps 206, 208, and 210, controller 26 is monitoring pressure sensor 36 looking for an increase in pressure at the outlet of pump 34, which is the result of the pressurized hydraulic fluid of the selected actuator 30 being fluidly connected to the outlet of pump 34. The communication passage through the valve 28 associated with the selected actuator 30 has just opened when the pressure increase is detected to thereby establish the threshold current necessary to open the selected valve 28. The threshold opening of the selected valve 28 establishes hydraulic connectivity between actuator 30 and pump 34.

Advantageously the present invention is automated such that it does not rely on an operator to determine the characteristic parameters necessary to optimize the system. Another advantage of the present invention is that the calibration procedure can be conducted on the vehicle, wherever the vehicle may be without the need for external test equipment. Yet another advantage of the present invention is that the calibration procedure can be done while the tractor is in service to accommodate component wear or component replacement in the field. This method allows for variation in system components and the algorithm is thereby adapted to accommodate for the manufacturing variation, to result in optimal system performance of the backhoe/loader system 10.

Having described the preferred embodiment, it will become apparent that various modifications can be made without departing from the scope of the invention as defined in the accompanying claims.

The invention claimed is:

1. A ground engaging vehicle, comprising:
a frame;
an engine connected to said frame;
a controller; and
a hydraulic system powered by said engine, said hydraulic system including:
a plurality of actuators;
a plurality of valves including a first valve associated with a corresponding one of said plurality of actuators, each of said plurality of valves being operatively connected to said controller; and
at least one sensor adapted to send a measured value to said controller, said measured value representative of a hydraulic connectivity through said first valve, said controller adapted to send a signal to each of said plurality of valves, said controller further adapted to establish, dependent upon said measured value, a threshold value representative of a signal necessary to activate said first valve, said controller being further adapted to establish a maximum flow current value for said first valve based upon adding a difference between said threshold value and at least one attribute of said first valve, read by said controller, to a previously and similarly established maximum flow current value.

2. The ground engaging vehicle of claim 1, wherein said at least one sensor includes a pressure sensor, said measured value being a hydraulic pressure value provided by said pressure sensor.

3. The ground engaging vehicle of claim 1, wherein said at least one attribute is a current flow, said threshold value being a threshold current.

4. A ground engaging vehicle, comprising:
a frame;
an engine connected to said frame;
a controller; and
a hydraulic system powered by said engine, said hydraulic system including:
a plurality of actuators;
a plurality of valves including a first valve associated with a corresponding one of said plurality of actuators, each of said plurality of valves being operatively connected to said controller; and
at least one sensor adapted to send a measured value to said controller, said measured value representative of a hydraulic connectivity through said first valve, said controller adapted to send a signal to each of said plurality of valves, said controller further adapted to establish a threshold value representative of a signal necessary to activate said first valve dependent upon said measured value, said plurality of actuators including a first actuator associated with said first valve, said first actuator being hydraulically driven full stroke with at least a predetermined hydraulic pressure, said threshold value being a threshold current value established by said controller by sending an increasing signal until said hydraulic connectivity is detected;
wherein said first valve has a memory associated therewith, said memory containing a previous threshold current value and a previously calculated maximum flow current value, said previously calculated maximum flow current value being replaced by a value calculated as said previously calculated maximum flow current value plus a difference between said threshold current value and said previous threshold current value, and said previous threshold current value being replaced by said threshold current value.

5. The ground engaging vehicle of claim 4, wherein said first valve is an electrohydraulic valve having a current sensitive device, said current sensitive device receiving said increasing signal, said threshold value being stored by said controller.

6. A ground engaging vehicle, comprising:
a frame;
an engine connected to said frame;
a controller; and
a hydraulic system powered by the engine, said hydraulic system including:
a plurality of actuators including a first actuator;
a plurality of valves including a first valve associated with a corresponding one of said plurality of actuators, each of said plurality of valves is operatively connected to said controller; and
at least one sensor adapted to send a signal to said controller indicating a flow of hydraulic fluid through said first valve, said controller being adapted to open said first valve allowing hydraulic fluid to pressurize said first actuator until said first actuator is driven to an end of its stroke, said controller is further adapted to close said first valve and send an increasing current to said first valve, said at least one sensor detects a flow of hydraulic fluid through said first valve, said controller being adapted to establish a threshold current value as the value of said increasing current when said at least one sensor detects a flow of the hydraulic fluid through said first valve;
wherein said controller is further adapted to establish a maximum flow current value for said first valve based upon adding a difference between said threshold current value and a previous threshold current value, read by said controller, to a previously calculated maximum flow current value.

7. The ground engaging vehicle of claim 6, wherein said at least one sensor is a pressure sensor, said pressure sensor detecting a hydraulic pressure valve.

8. The ground engaging vehicle of claim 6, wherein said first valve is an electrohydraulic valve having a current sensitive device, said current sensitive device receiving said increasing current, said threshold current value being stored by said controller.

9. The ground engaging vehicle of claim 8, wherein said first valve has a memory associated therewith, said memory containing said previous threshold current value and said previously calculated maximum flow current value, said previously calculated maximum flow current value being replaced in said memory by said established maximum flow current value, and said previous threshold current value being replaced in said memory by said threshold current value.

10. A method of calibrating a hydraulic system associated with a ground engaging vehicle, the steps including:
opening a valve allowing hydraulic fluid to pressurize an actuator until said actuator is driven to an end of its stroke;
closing said valve;
sending an increasing current to said valve;
detecting a flow of hydraulic fluid through said valve;

establishing, by a controller, a threshold current value as the value of said increasing current when said detecting step detects said flow of said hydraulic fluid through said valve; and establishing a maximum flow current value for said valve based upon adding a difference between said threshold current value and a previous threshold current value, read by said controller, to a previously and similarly established maximum flow current value.

11. The method of claim 10, further comprising the step of storing said maximum flow current value and said threshold current value.

12. A method of calibrating a valve comprising:

providing a controller, a memory associated with said controller, and a hydraulic system, said hydraulic system including:

a plurality of valves, including a first valve, wherein said controller is configured to transmit a current signal to at least said first valve to control flow of fluid through said first valve and wherein said first valve is initially closed, and a sensor configured to determine a flow indicator associated with said first valve and provide an indication of said determined flow indicator to said controller;

providing, by said controller, a first current signal to said first valve;

determining, by said controller, whether providing said first current signal results in flow of said fluid through said first valve, based upon, at least in part, receiving a first indication from said sensor of a first flow indicator determined by said sensor;

if providing said first signal does not result in flow through said first valve, increasing, by said controller, an aspect of said first current signal at least until a second indication of a second flow indicator, received by said controller from said sensor, corresponds to flow of said fluid through said first valve;

identifying, by said controller, an initial open state of said valve based upon, at least in part, determining that at least one of said first and second indications received from said sensor corresponds to an initial flow through said first valve;

identifying, by said controller, a present threshold current value equal to a value of said first current signal when said first valve reaches said initial open state;

identifying, by said controller, a previous threshold current value corresponding to a previous initial open state of said first valve;

determining, by said controller, a present difference between said present threshold current value and said previous threshold current value;

identifying, by said controller, a previous maximum current value corresponding to a previous maximum flow through said first valve, said previous maximum current value being determined based upon: (1) previous identification, by said controller, of a first historic threshold current value and a second historic threshold current value, (2) previous determination, by said controller, of a difference between said first historic threshold current value and said second historic threshold current value, and (3) previous addition, by said controller, of a historic maximum current value and said difference between said historic threshold current values;

wherein said first and second historic threshold current values correspond, respectively, to a first and second historic initial open state of said first valve, said first historic initial open state occurring after said second historic initial open state, and wherein said historic maximum current value is determined prior to said previous maximum current value and corresponds to a historic maximum flow through said first valve; and determining, by said controller, a present maximum current value corresponding to a present maximum flow condition for said first valve by adding said previous maximum current value to said present difference between said present and previous threshold current values.

13. The method of claim 12 wherein said flow indicator is a fluid pressure.

* * * * *